US006811442B1

(12) United States Patent
Lien et al.

(10) Patent No.: US 6,811,442 B1
(45) Date of Patent: Nov. 2, 2004

(54) POSITIONING SEAT WITH NESTS FOR COILS FOR A CONNECTOR

(75) Inventors: Wen-Fu Lien, Tao Yuan Shien (TW); Cheng-Chou Chiang, Tao Yuan Shien (TW)

(73) Assignee: Superworld Electronics Co., Ltd., Tao Yuan Shien (TW)

( * ) Notice: Subject to any disclaimer, the term of this patent is extended or adjusted under 35 U.S.C. 154(b) by 0 days.

(21) Appl. No.: 10/732,293

(22) Filed: Dec. 11, 2003

(51) Int. Cl.[7] ..... H01R 33/945
(52) U.S. Cl. ..... 439/620; 439/676
(58) Field of Search ..... 439/620, 921, 439/676

(56) References Cited

U.S. PATENT DOCUMENTS 6,102,741 A * 8/2000 Boutros et al. ..... 439/620
6,319,064 B1 * 11/2001 Belopolsky et al. ..... 439/620
6,428,361 B1 * 8/2002 Imschweiler et al. ..... 439/620
6,554,638 B1 * 4/2003 Hess et al. ..... 439/676
6,568,966 B1 * 5/2003 Korsunsky et al. ..... 439/620

* cited by examiner

*Primary Examiner*—P. Austin Bradley
*Assistant Examiner*—Briggitte R. Hammond
(74) *Attorney, Agent, or Firm*—Troxell Law Office PLLC

(57) ABSTRACT

A positioning seat with nests for coils for a connector, the connector has on the top thereof a printed circuit board having a resistance-capacitance (RC) element, the printed circuit board is connected thereon with a plurality of coils for wave filtering and abnormal voltage isolating; the coils are positioned by a positioning device formed from the positioning seat and a lateral connecting plate connectable with the seat as well as connecting in advance with metallic guide needles, the positioning seat is shaped in advance to have the nests mutually spaced away and in an amount same as that of the coils; so that each coil is placed in a nest in advance for using in operation of electric connecting with related members and the printed circuit board.

1 Claim, 4 Drawing Sheets

POSITIONING SEAT WITH NESTS FOR COILS FOR A CONNECTOR

BACKGROUND OF THE INVENTION

1. Field of the Invention

The present invention is related to a positioning seat with nests for coils for a connector, and especially to a positioning device to position a plurality of coils for wave filtering and abnormal voltage isolating of a corresponding amount same as that of nests in advance, thereby related members and a printed circuit board can perform the operation of electric connecting.

2. Description of the Prior Art

Generally, coils connected in an electric communication connector has the function of wave filtering and abnormal voltage isolating, and can be used as a network-card connector such as RJ45. By the fact that grade of frequency of transmission signals of such a connector are generally 10, 100 and 1000 MHZ, integrated electric circuits (IC) mostly only can receive frequencies within such a range, a connector added therein with filtering coils can filter off the noises not belonging to this range of grade of frequency. And when there is abnormal voltage in signal transmission, the components are subjected to damage; coil circuits added for a connector can be beneficial to isolation and grounding of an abnormal voltage that is probably generated.

In such a conventional connector having coils, the coils mostly are connected on a printed circuit board in a mode of random sticking, and there have been a lot of disadvantages induce therefrom. A structure of such a conventional connector is shown in FIG. 1, the main body 10 of the connector is mounted on the top thereof with a plurality of coils 11, these coils 11 are randomly positioned on a printed circuit board 12, and then are sealed with filling glue 13. The way of requisite line connecting among these coils 11 and between them and the printed circuit board 12 for the functioning of wave filtering and abnormal voltage isolating is a known technique, and no further description is required.

However, in the positioning structure of the above stated coils for the connector, by virtue that a plurality of coils 11 are randomly stuck and positioned on the surface of a printed circuit board 12 for connecting, in such a processing mode, the coils are not accurately positioned, the feature of a product thereby is unstable, and a latent blemish of quality exists. By the reason that the divisional stages in processing is not evident due to random positioning for connecting, examination of semi-finished products is difficult, mass production of the conventional connector still has the defect of ununiform quality. And such a conventional processing mode of random positioning and connecting must uses skilled operators; not only the degree of skillfulness of the operators can decide quality, but also the rate of discarding of products with blemishes is high, these may increase the cost of production, thereby the connector is undesired and has to be improved.

SUMMARY OF THE INVENTION

The primary object of the present invention is to provide a positioning seat with nests for coils for a connector, it takes the processing under the condition of having the coils in nests separated, the feature and quality of its products are more stable and reliable.

Another object of the present invention is to provide a positioning seat with nests for coils for a connector, the processing of such a connector is simplified, dependence of the processing quality of its products on the skillfulness of operators is largely reduced and thus cost of production can be lowered.

Another object of the present invention is to provide a positioning seat with nests for coils for a connector; examination of its semi-finished products is easy, quality of mass production of the connector on its production line is elevated.

To obtain the object, the connector of the present invention has on the top thereof a printed circuit board having a resistance-capacitance (RC) element, the printed circuit board is connected thereon with a plurality of coils for wave filtering and abnormal voltage isolating, the plural coils are positioned by a positioning device formed from the seat and a lateral connecting plate connectable with the seat as well as connecting in advance with metallic guide needles, the seat is shaped in advance to have a plurality of nests mutually spaced away and in an amount same as that of the coils; so that every coil can be placed in a nest in advance for using in the operation of electric connecting with related members and the printed circuit board.

In the preferred embodiment, each nest can be provided with slits with different depths on the top surface near the periphery of the nest, between a nest and the other, and between each nest and an external edge of the seat in pursuance of the mode of electric connecting required.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
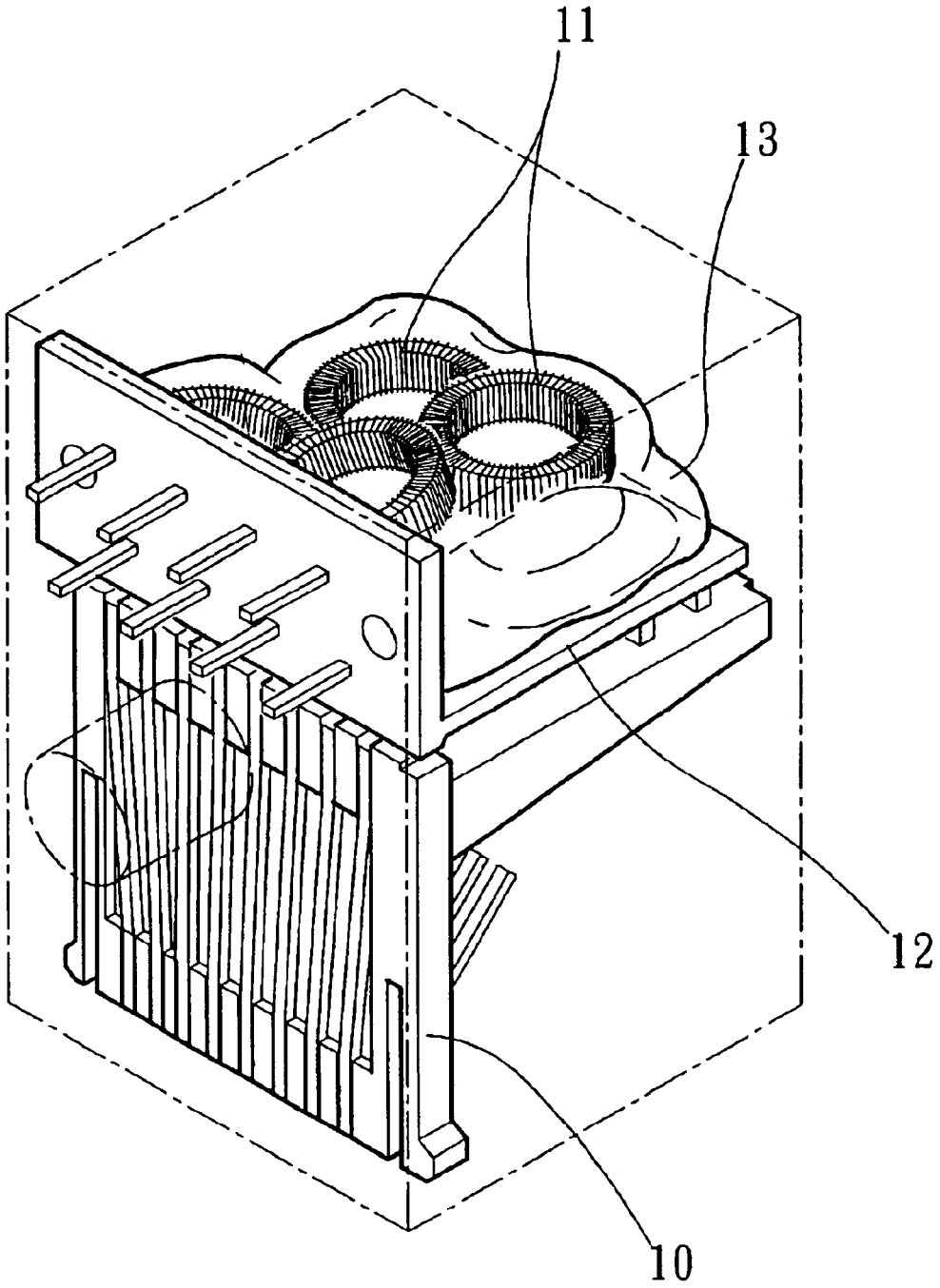
FIG. 1 PRIOR ART
FIG. 1 is a perspective view of a positioning structure for coils of a conventional connector.
Figure 2:
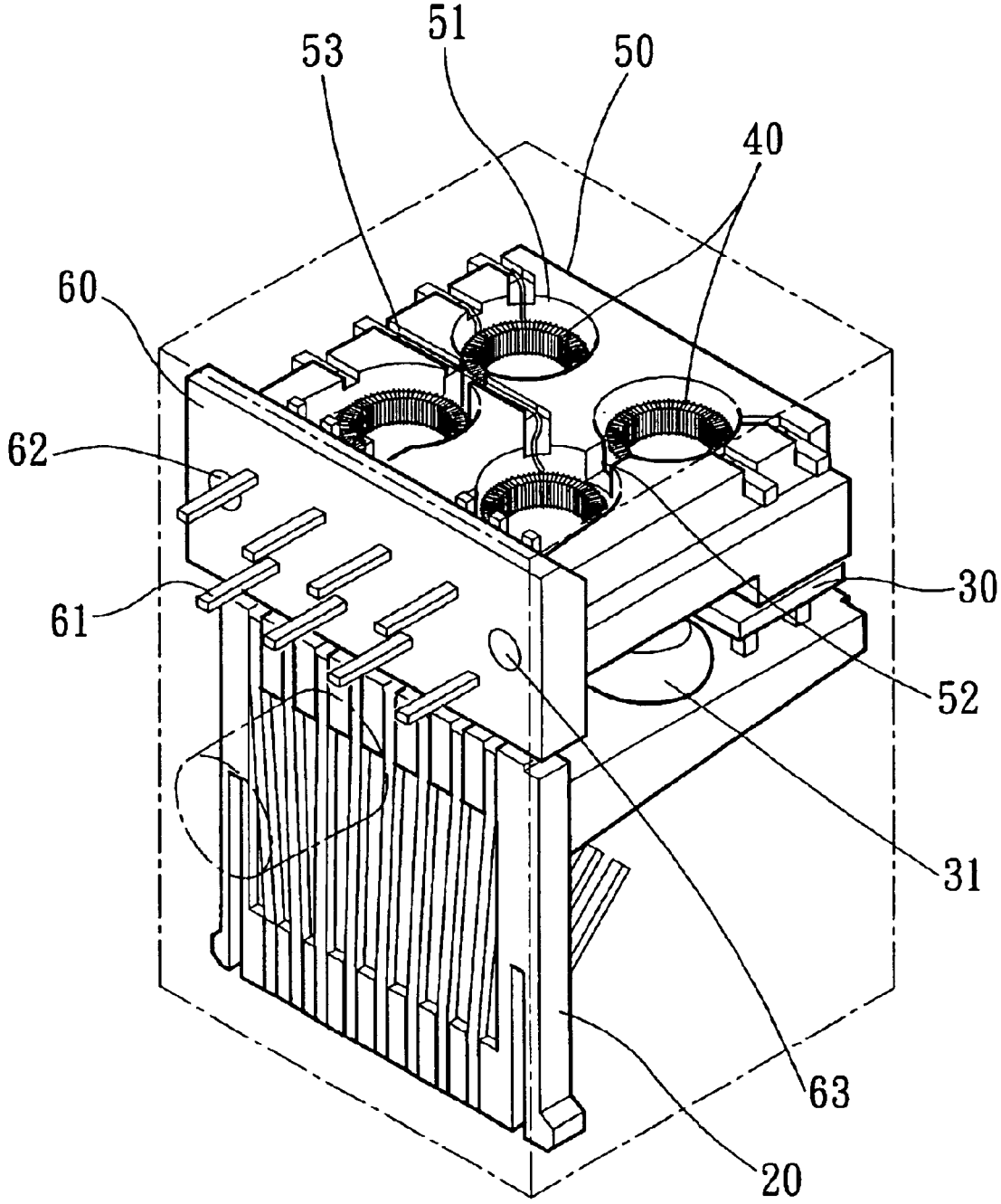
FIG. 2 is a perspective view of a preferred embodiment of the present invention.
Figure 3:
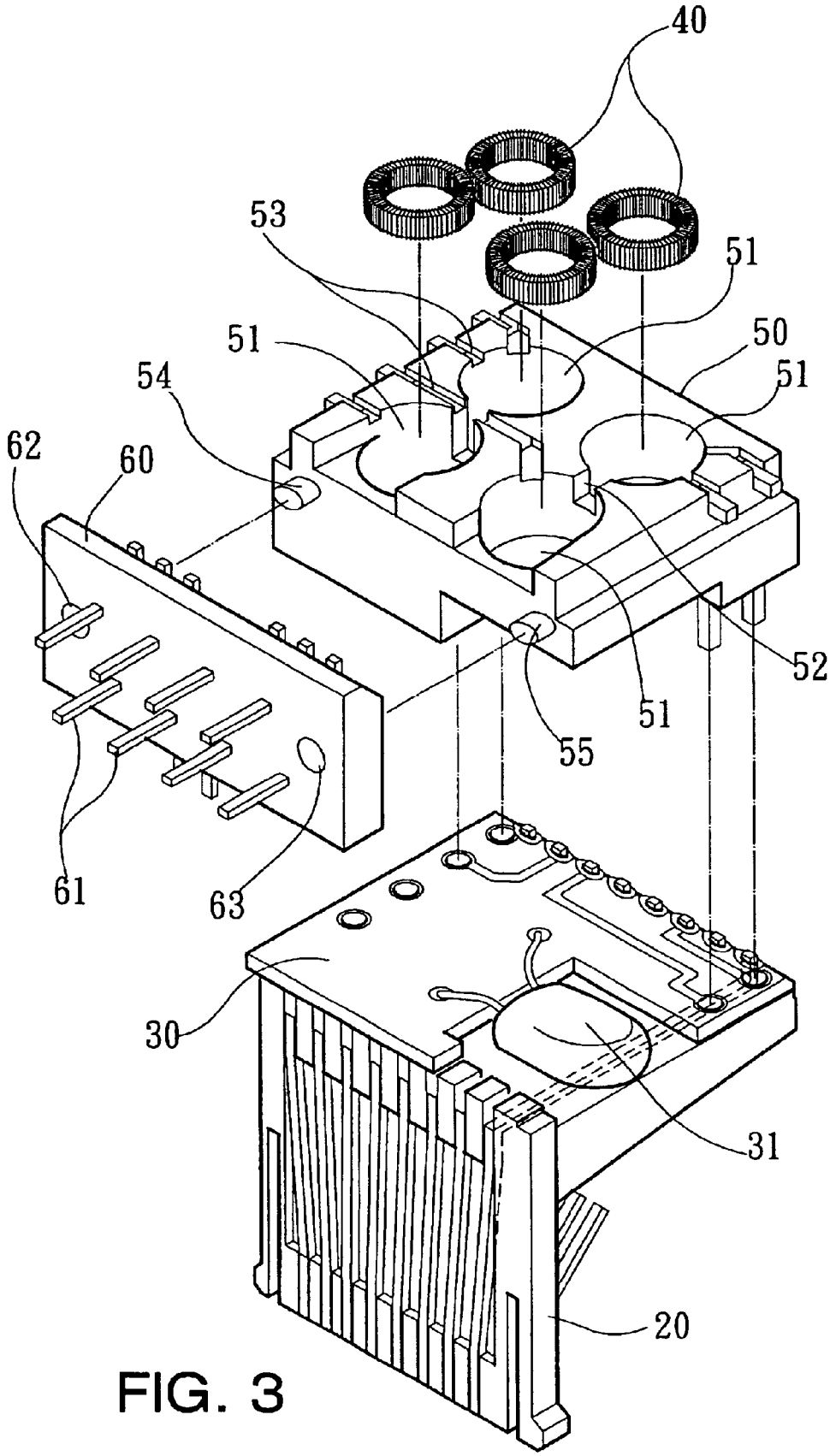
FIG. 3 is an analytic perspective view showing the elements in FIG. 2.
Figure 5:
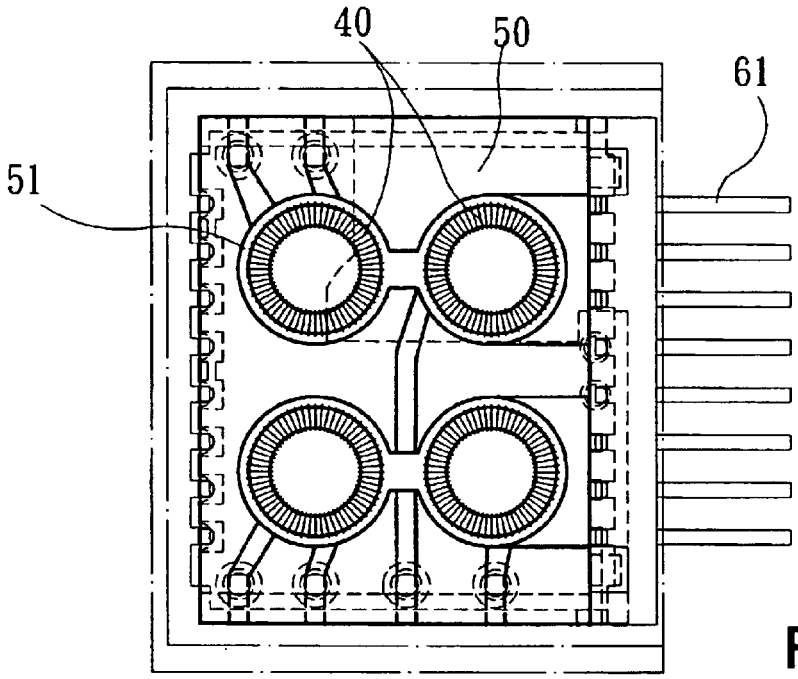
FIG. 5 is a top view taken from FIG. 2
Figure 4:
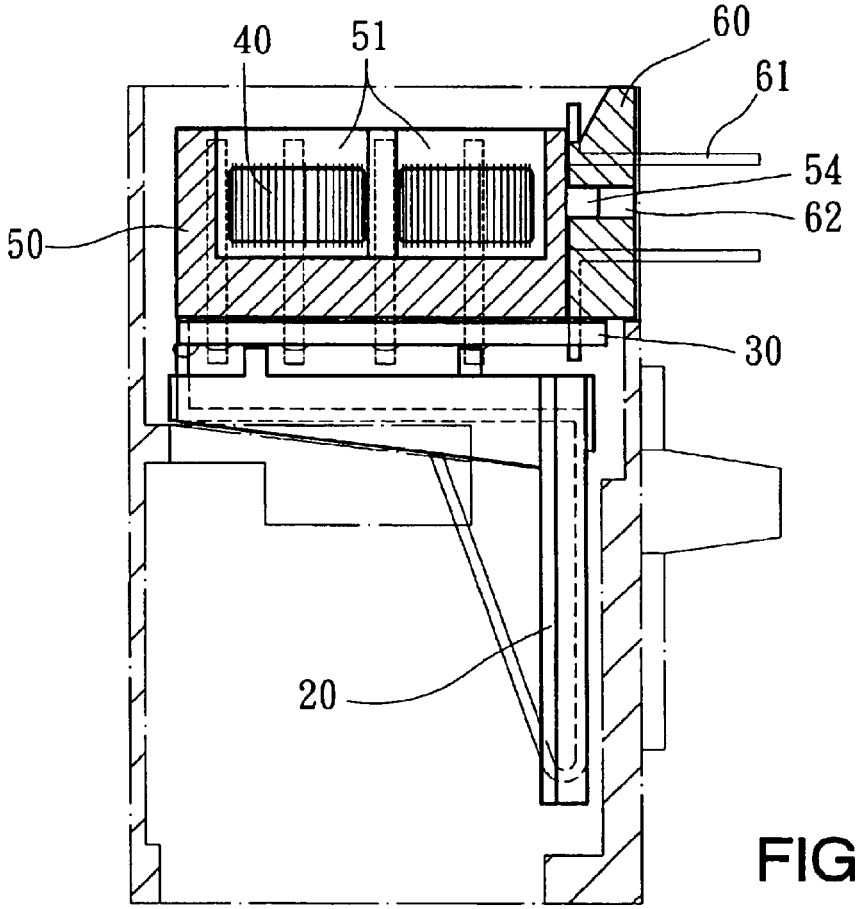
FIG. 4 is a sectional view taken from FIG. 2.

Referring to FIGS. 2–5, in the embodiment depicted, a connector 20 has on the top thereof a printed circuit board 30 having a resistance-capacitance (RC) element 31, in the preferred embodiment, the positioning device for coils 40 of the present invention is formed from an integrally injection molded seat 50 and a lateral connecting plate 60 connectable for assembling with the seat 50.

The above stated seat 50 can be integrally formed of material such as plastic, and is shaped in advance to have a plurality of nests 51 mutually spaced away and in an amount same as that of the coils 40; in this preferred embodiment, the diameter and the depth of each nest 51 are both a little larger than the diameter and the thickness respectively of a coil 40, so that each coil 40 can be placed in a nest 51 in advance. And each nest 51 can be provided with slits 52, 53 with different depths on the top surface near the periphery of the nest 51, between a nest 51 and the other nest 51, and between each nest 51 and an external edge of the seat 50 in pursuance of the mode of electric connecting required.

In the preferred embodiment depicted, the seat 50 is provided with protrusions 54, 55 on a side thereof in juxtaposition with the lateral connecting plate 60, the lateral connecting plate 60 is provided in advance with lines of metallic guide needles 61, and is provided with through holes 62, 63, so that the seat 50 and the lateral connecting plate 60 can be assembled with each other.

When the present invention with the above stated structure is in the operation of assembling, each coil is placed in a nest, and then processing of connecting of the coils with the printed circuit board 30 is performed. Such an improved structure and the brand new mode of processing derived therefrom has at least the following advantages:

1. The present invention takes the processing under the condition of having the coils in nests separated; the feature and quality of its products are more stable and reliable than the conventional mode of random sticking.
2. The processing of the present invention is simplified, dependence of the processing quality of its products on the skillfulness of operators is largely reduced and thus cost of production can be lowered.
3. Examination of the semi-finished products of the present invention is easy, this not only can lower its cost of production, but also quality of mass production on its production line is elevated.
4. The present invention is suitable for mass production with divisional stages in processing to increase the efficiency of production.

The embodiment cited above is only for illustrating a preferred embodiment of the present invention; it will be apparent to those skilled in this art that various modifications or changes can be made to the elements of the present invention without departing from the spirit and scope of this invention. Accordingly, all such modifications and changes also fall within the scope of the appended claims.

What is claimed is:

1. A positioning seat with nests for coils for a connector, said connector has on a top thereof a printed circuit board having a resistance-capacitance (RC) element, said printed circuit board is connected thereon with a plurality of coils for wave filtering and abnormal voltage isolating, said positioning seat is characterized in that: said coils are positioned by said positioning seat which forms a positioning device by assembling with a lateral connecting plate connectable with said seat as well as connecting in advance with metallic guide needles, said positioning seat is shaped in advance to have said nests mutually spaced away and in an amount same as that of said coils; so that each of said coils is placed in a nest in advance for using in operation of electric connecting with related members and said printed circuit board, wherein each of said nests is provided with slits with different depths on a top surface near the periphery of said nest, between one and the other of said nests, and between each of said nests and an external edge of said positioning seat in pursuance of mode of electric connecting required.

* * * * *